US009321624B2

(12) United States Patent
Jespersen

(10) Patent No.: US 9,321,624 B2
(45) Date of Patent: Apr. 26, 2016

(54) SADDLE PAD, IN PARTICULAR FOR USE AS A PAD FOR A WESTERN SADDLE

(71) Applicant: Brian Kronborg Jespersen, Hjallerup (DK)

(72) Inventor: Brian Kronborg Jespersen, Hjallerup (DK)

( * ) Notice: Subject to any disclaimer, the term of this patent is extended or adjusted under 35 U.S.C. 154(b) by 62 days.

(21) Appl. No.: 13/892,943

(22) Filed: May 13, 2013

(65) Prior Publication Data

US 2014/0331621 A1 Nov. 13, 2014

(51) Int. Cl.
*B68C 1/12* (2006.01)

(52) U.S. Cl.
CPC ..... *B68C 1/12* (2013.01)

(58) Field of Classification Search
CPC ..... B64C 1/12; B64C 1/126; B64C 1/02; B64C 1/08
USPC ..... 54/65, 66, 79.3, 44.5, 44.6, 44.1
See application file for complete search history.

(56) References Cited

U.S. PATENT DOCUMENTS

| | | | | |
|---|---|---|---|---|
| 426,042 | A * | 4/1890 | Mudford | 54/66 |
| 882,871 | A * | 3/1908 | Hogan | 474/58 |
| 1,795,304 | A * | 3/1931 | Howard | 267/117 |
| 3,343,338 | A | 9/1967 | Stubben | |
| 4,979,249 | A * | 12/1990 | Meade, II | 5/644 |
| 5,548,948 | A | 8/1996 | Smith et al. | |
| 5,555,710 | A | 9/1996 | Smith | |
| 5,787,692 | A | 8/1998 | Purdy | |
| 5,802,823 | A | 9/1998 | Woods | |
| 6,050,067 | A | 4/2000 | Knight | |
| 6,658,827 | B2 | 12/2003 | Brownlie | |
| 7,137,236 | B2 | 11/2006 | Brownlie | |
| 2003/0177742 | A1 | 9/2003 | Brownlie | |
| 2004/0244340 | A1 | 12/2004 | Brownlie | |
| 2010/0107574 | A1 | 5/2010 | Rajewski | |

FOREIGN PATENT DOCUMENTS

| | | |
|---|---|---|
| EP | 1837302 | 9/2007 |

OTHER PUBLICATIONS

English Abstract of EP1837302.

* cited by examiner

*Primary Examiner* — Lisa Tsang
*Assistant Examiner* — Magdalena Topolski
(74) *Attorney, Agent, or Firm* — Dykema Gossett PLLC

(57) ABSTRACT

A saddle pad for use with a western saddle includes a felt cover containing two air cushions inserted into cavities on each side of a central line of the pad, each cushion partly filling at least the front half of the cavity and partly is provided with barrier walls extending forwardly from the rear wall of the cushion, and a single pump connected to the two cushions to supply the same pressure to provide better comfort for the rider and to the horse during riding.

8 Claims, 8 Drawing Sheets

SADDLE PAD, IN PARTICULAR FOR USE AS A PAD FOR A WESTERN SADDLE

BACKGROUND OF THE INVENTION

The invention relates to a western saddle, which includes a pad having an upper layer, preferably made of felt, and an associated lower layer made of two layers that are stitched together, thereby forming two cavities in which a flexible air-tight cushion is accommodated, the cushion being attached to a flexible carrier member and provided with an air valve for inflating.

A saddle pad of this type serves to keep the saddle clean and to absorb sweat, which would otherwise make the saddle slippery and possibly result in its sliding on the horse.

There is a special need for a pad when riding in a so-called western saddle, as its special configuration makes it heavy and moreover stiff, e.g., to enable it to withstand the pull from a lasso, when this is secured to the saddle knob, the horn.

The weight and the stiffness often result in pressure injuries on the horse, and since the stiff configuration has a limited contact face with the back of the horse, there will a great risk of so-called pressure injuries on the horse.

It is known to provide saddle pads with pressure absorbing and pressure-distributing pads inserted into a saddle pad. Thus, it is known from U.S. Pat. No. 7,137,236 B2 to insert a foam cushion in the pad, for absorbing and distributing the weight.

This solution, however, is not suitable for riding in a western saddle, since the contact with the horse is transferred as a resilient and thereby "soft" contact, which is inexpedient. To this should be added that the pressure absorbing capacity of the cushions will be impaired after a short period of use because the foam will be compressed to the detriment of the pressure distribution, which will be reduced correspondingly.

To remedy this defect, it is known from EP 1 837 302 A1 to insert an air-filled cushion into the pad on each side of the central line.

These two cushions will be able to distribute the weight, but this solution, too, is not suitable for use when riding in a western saddle. The air in the cushion will be distributed such that there will be least air where the pressure is greatest such that the saddle and thereby the rider will feel as if he was sitting on an air cushion. This feeling of a swimming or rocking riding makes the pad unsuitable for use below a western saddle.

U.S. Pat. No. 5,555,710 discloses a western saddle in which two inflatable cushions are formed as one cushion, with the two cushions connected by communicating channels, provided with one valve.

By having two cushions that are connected, air from one cushion will move to the other cushion due to the movements of the horse during ridding. This means that the rider will feel a rocking movement of the saddle to the discomfort for the rider and the horse as well.

THE OBJECT OF THE INVENTION

It is the object of the invention to increase the flexibility and improve the comfort for a rider and his horse by using a pad with two separate cushions, each of which has an air valve, and wherein a pump unit is connected to the valves.

It is an advantage if the pump unit is fixed to a male connection part having two male outlets, said outlets being connectible to a female connection part having two female inlets, the female connection part being fixed to the two valves.

In this way the same pressure in the two cushions are achieved.

The male connection part scan have two tongues adapted to grip the female connection part, such that a useful quick releasable connection is achieved.

When one or more barrier was are arranged at the rear in each cushion, the barrier walls extend from the rear wall of the cushion and a distance forwardly, such that the tendency of the air to move in the cushion, viz. away from the pressure area, will be limited additionally, as the walls will serve as boundaries for the movement of the air in the cushion.

When at least one of the barrier walls extends essentially in parallel with the central line of the pad, and that at least one barrier wall extends between the rear wall of the cushion and the outermost lateral wall, the aft cushions will be disposed at the most effective locations, viz. where the saddle rests and presses against the back of the horse.

When the barrier walls have a length which essentially corresponds to half the length of the cushion, wave motions of the air will be limited as much as possible.

When the barrier was are formed by stitching the opposed cushion layers together, it will be ensured that the cushions do not get too bulky, that is thick, and also that they remain relatively flat.

When the cushions are made of airtight sheet, the assembly to form the walls may take place by hot melting or vulcanization.

BRIEF DESCRIPTION OF THE DRAWINGS

An example of an embodiment of a saddle pad according to the invention will be described more fully below with reference to the drawings, in which.

DESCRIPTION OF THE EXEMPLARY EMBODIMENTS

Figure 1:
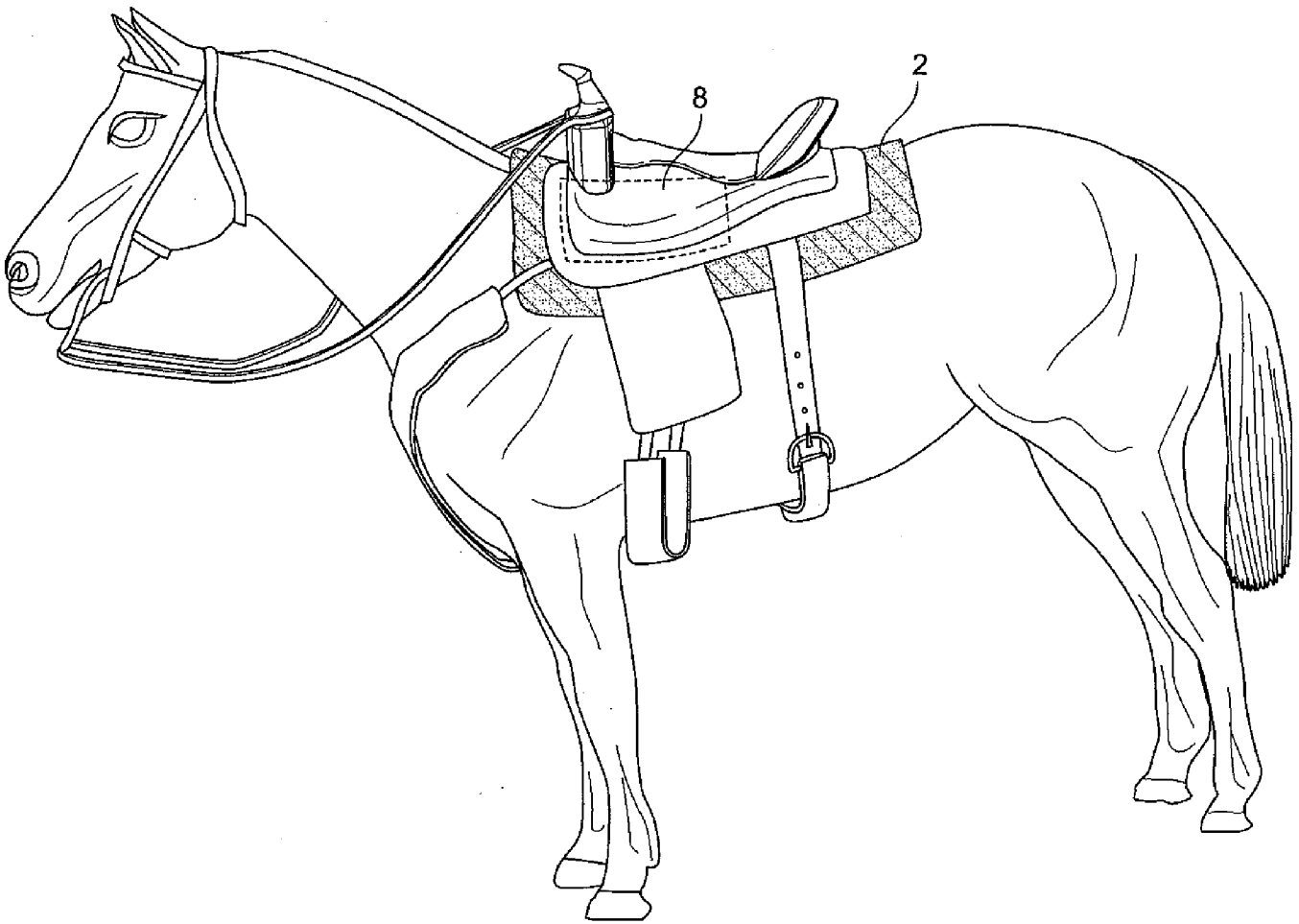
FIG. 1 shows a saddled horse with a western saddle and a pad according to the invention.

The invention will be described below based on an example of a saddle pad 2, which, as shown in FIG. 1, is used in connection with a western saddle.

Such a saddle is characterized in that it is a stiff saddle in contrast to a leather saddle, and provided at the front with a horn at the centre at the seat and a cantle.

Figure 2:
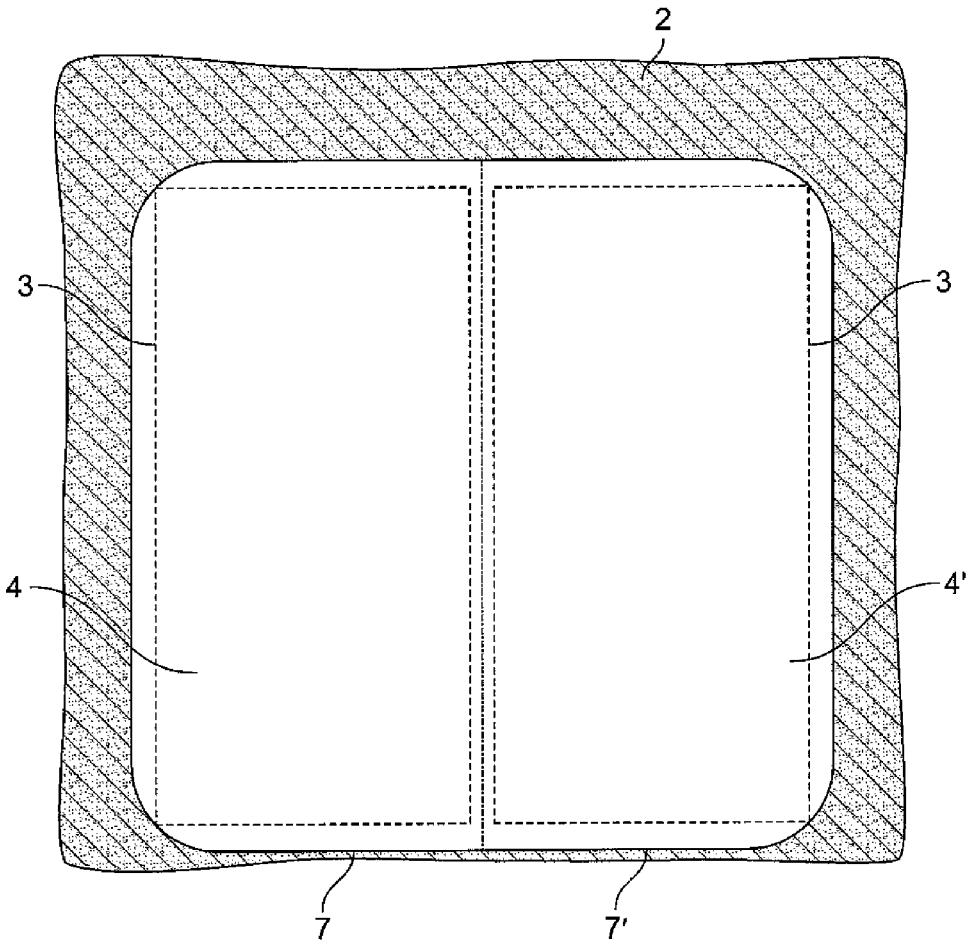
FIG. 2 shows the pad of FIG. 1 seen with its upside turned down.
Figure 3:
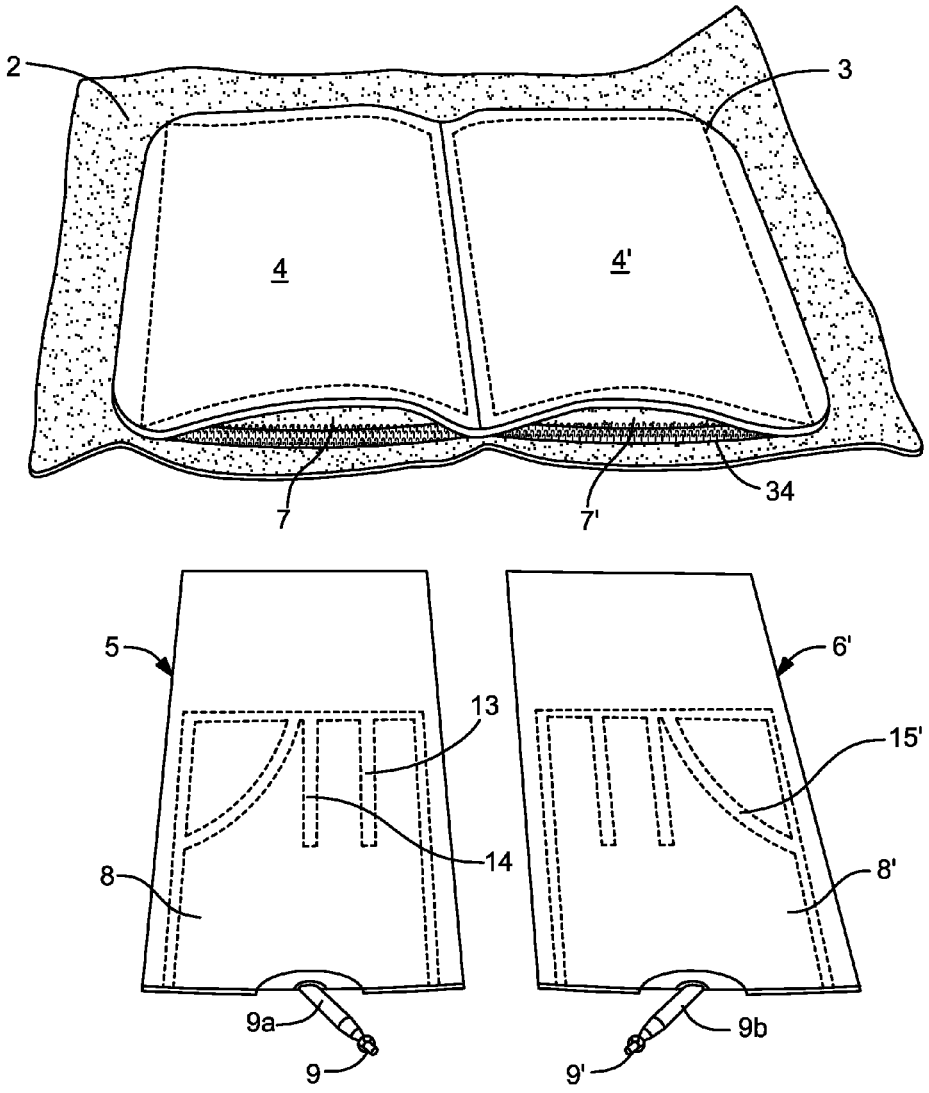
FIG. 3 shows the pad of FIG. 2 with open cavities and the cushions that are positioned therein.

The pad 2 is shaped with a so-called schabrack shape, which is a four-sided shape, as shown in FIG. 2 and FIG. 3.

The pad comprises an upper layer made of strong felt 2*a* and of two side-by-side layers 4,4' that are stitched together and to the felt 2*a*, as indicated by the dashed line 3. These layers define two cavities or pockets 7,7' adapted to receive flexible carrier members 5,6' on which upper surfaces two air cushions 8,8' cf. below are arranged (forming cushion assemblies). Where it is desired to have the option of exchanging the carrier members 5,6', the front edges of the layers 2 and 4,4' and felt 2*a* are not stitched together, but may be provided with some form of closure, such as a Velcro closure, as indicated by 34 in FIG. 3.

Each cushion 8 and 8 is made of an airtight material, so that each may be inflated via a valve 9, 9*a* and 9', 9*b*. The purpose of these cushions is to absorb and distribute the pressure which is exerted by the saddle on the back of the horse. This provides protection against pressure injuries, just as the engagement of the saddle with the horse may be adapted by a suitable selection of the air pressure.

To ensure the desired contact between rider and horse, however, the saddle must be secured to the horse more or less immovably.

This is a requirement for the pad to operate in connection with a western saddle.

Figure 4:
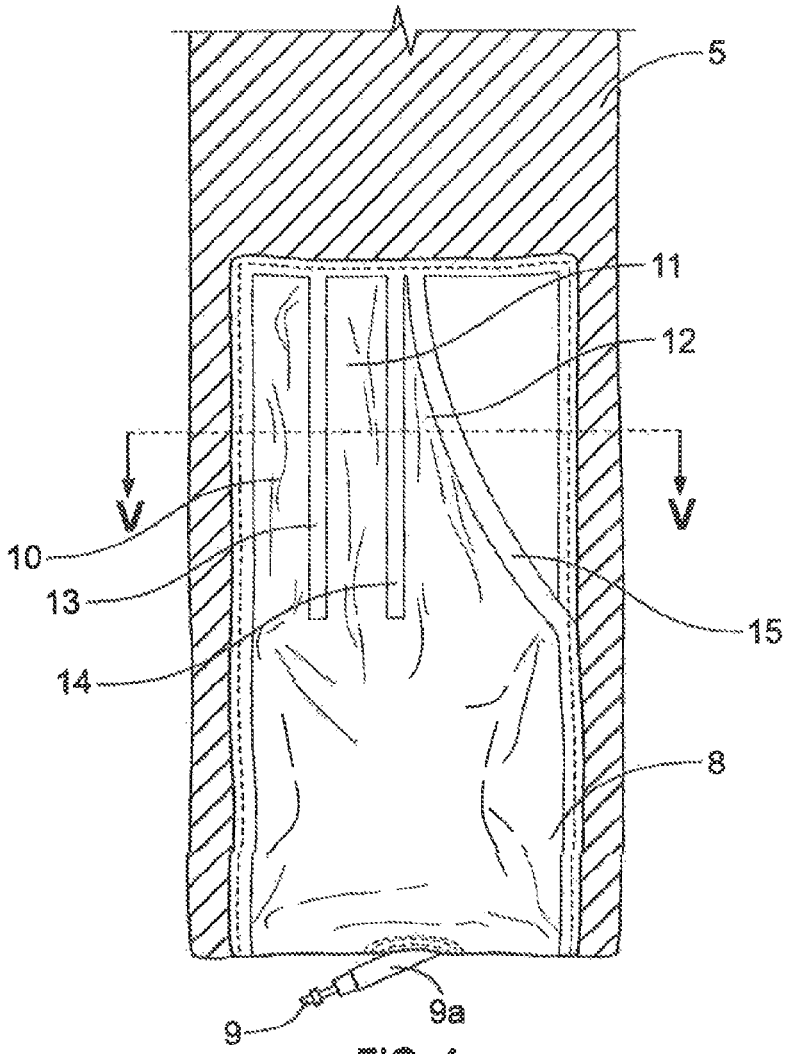
FIGS. 4 and 6 show the left and right cushions, respectively.
Figure 5:
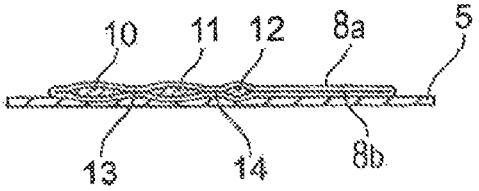
FIGS. 5 and 7 show a sectional view of left and right cushions, respectively, seen in the direction V-V in FIG. 4 and VII-VII in FIG. 6.
Figure 6:
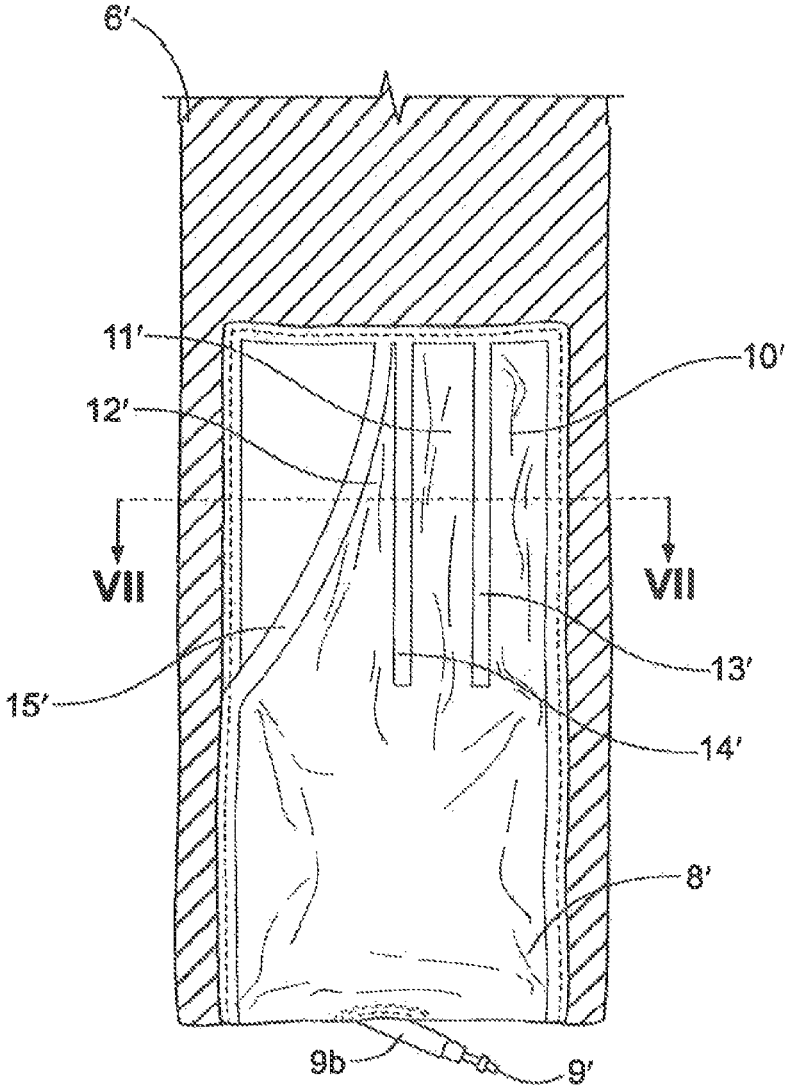
Figure 7:
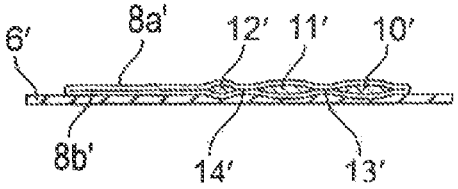

Therefore, as shown in FIGS. 4-7, the air cushions are provided with a cavity disposed at the front, the cavity being positioned at the contact area between the saddle and the horse, and with two partition walls 13, 14 and 13', 14' at the rear extending in parallel in the example shown. As seen in FIGS. 5 and 7, the partition walls 13', 14' are formed by connections of opposed layers 8*a*, 8*b* of cushion 8 and opposed layers 8*a'*, 8*b'* of cushion 8'.

These walls serve to limit the movement of the air during riding, as they partly reduce the volume in which the air is present and partly limit the flow between the various areas 10, 11, 12 and 10', 11', 12' in the cushion. Hereby, the air movements and the airflows are dampened, and the rider feels that there is a firm contact with the horse.

FIGS. 4 and 6 moreover show a barrier wall 15 and 15', which extends between the rear side and the lowermost lateral edge. These walls serve to reduce the volume of air so that air will primarily be present where the engagement pressure is.

Valves 9, 9*a* and 9', 9*b* are mounted for the regulation of the air pressure and/or the air volume in the cushions, the valves serving to supply air to the cushions and to allow the air pressure/air amount to be adjusted, such that the pressure from the saddle is distributed as best as possible across the back of the horse. This protects the horse against pressure injuries, and it is moreover ensured that the blood flow of the horse in the skin remains intact, thereby completely avoiding pressure sores.

The example shown includes partition walls extending in parallel and a boundary wall extending obliquely, but, of course, there may be more or fewer depending on the need for regulation of the airflow and the configuration of the air compartments of the cushion. This makes it possible to adapt the pad to the horse and the shape and size of the saddle.

Figure 8:
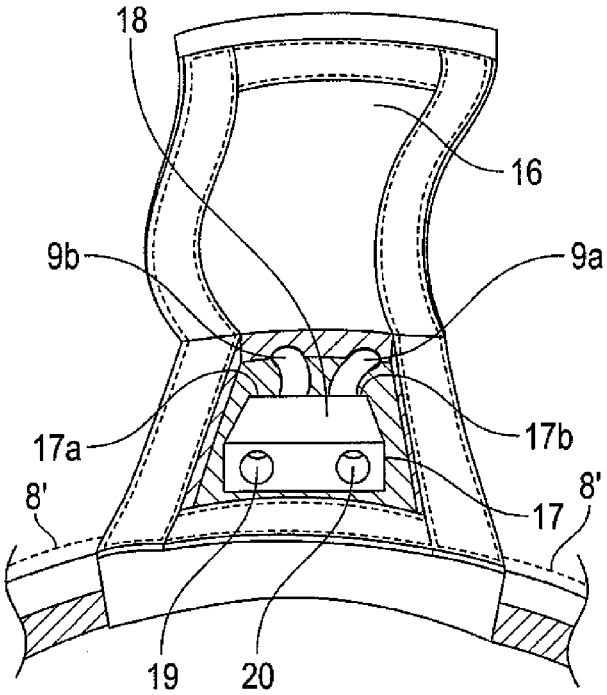
FIG. 8 shows in a preferred embodiment of the invention a connection part to the valves on FIG. 3.

In FIG. 8, a female connection part 18 is fixed to the valves 9*a*, 9*b*. A closure 16, shown in open position, is intended to cover the connection part 17.

A closure 16, shown in open position, is intended to cover the connection part 17.

Figure 9:
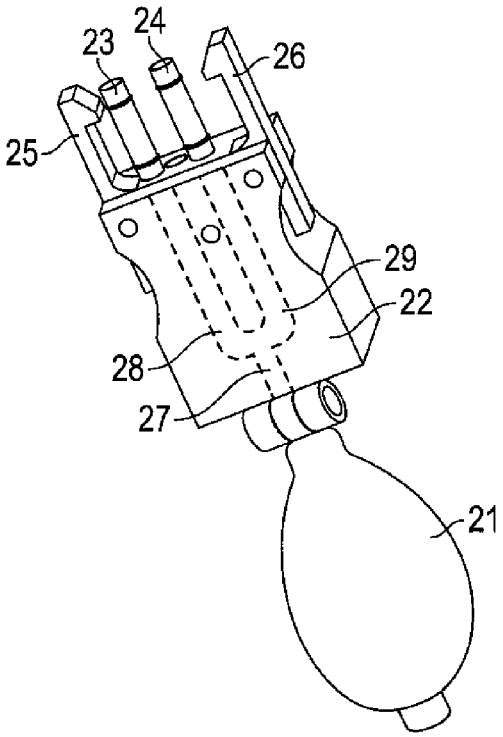
FIG. 9 shows a pump unit connectible to the connection part of FIG. 8.
Figure 10:
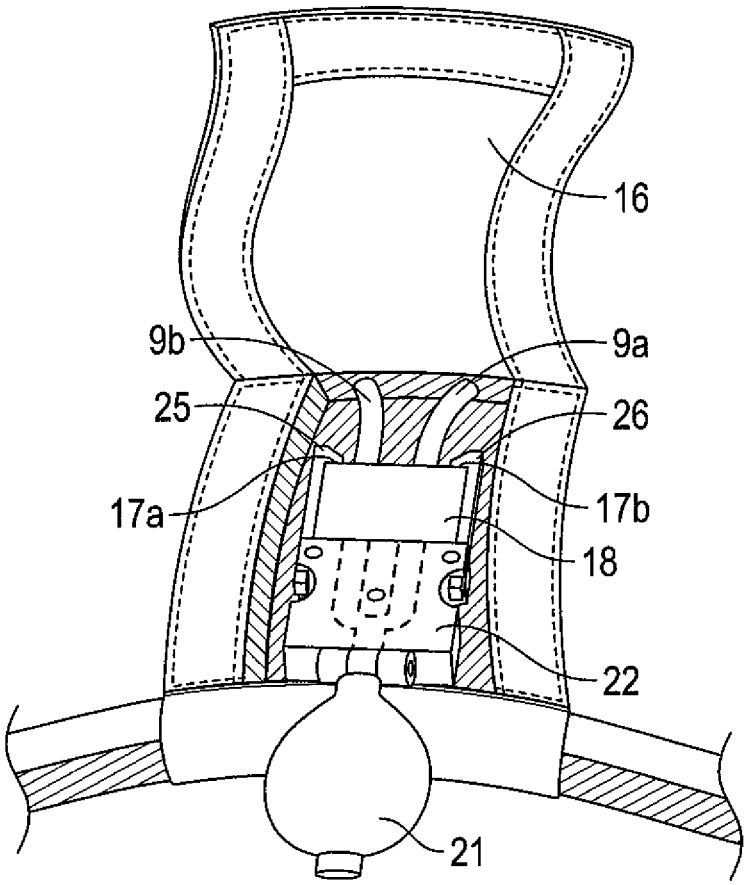
FIG. 10 shows the pump unit connected to the connection part of FIG. 8.

The female connection part 17 has two female inlets 19, 20, adapted to receive male outlets 23, 24 arranged in a male connection part 22, cf, FIG. 9.

The male connection part 22 has two tongues 25, 26 that can be rotated around axis 30, 31. Two arcs in the male connection part 22 are denoted 32, 33.

A pump 21 is connected to the male connection part 22. As it can be seen, channels 27, 28, 29, shown with dashed lines are provided inside the male coupling part 22. When pump 21 is activated, a flow in the channels will transmit flow to the male outputs 23,24 and further to the female inlets 19,29 then transmit air to the valves 9*a*, 9*b* and then into the cushions 8, 8', The devices shown connection part explained above is operated as follows.

When the male outputs 23, 24 in the female inlets 19, 20, then the tongues 25, 26 will provide a snap coupling so that the tongues will grip on edges 17*a*, 17 *b* and hold the connection part in a form position.

When it Is desired to free the male connection part 22 from the female connection part 18, then a pressure on the tongues in the arcs 31, 32 will force the tongues to be rotated around axis 30, 31 and disconnect the male connection part from the female connection part with a pull motion.

Figure 11:
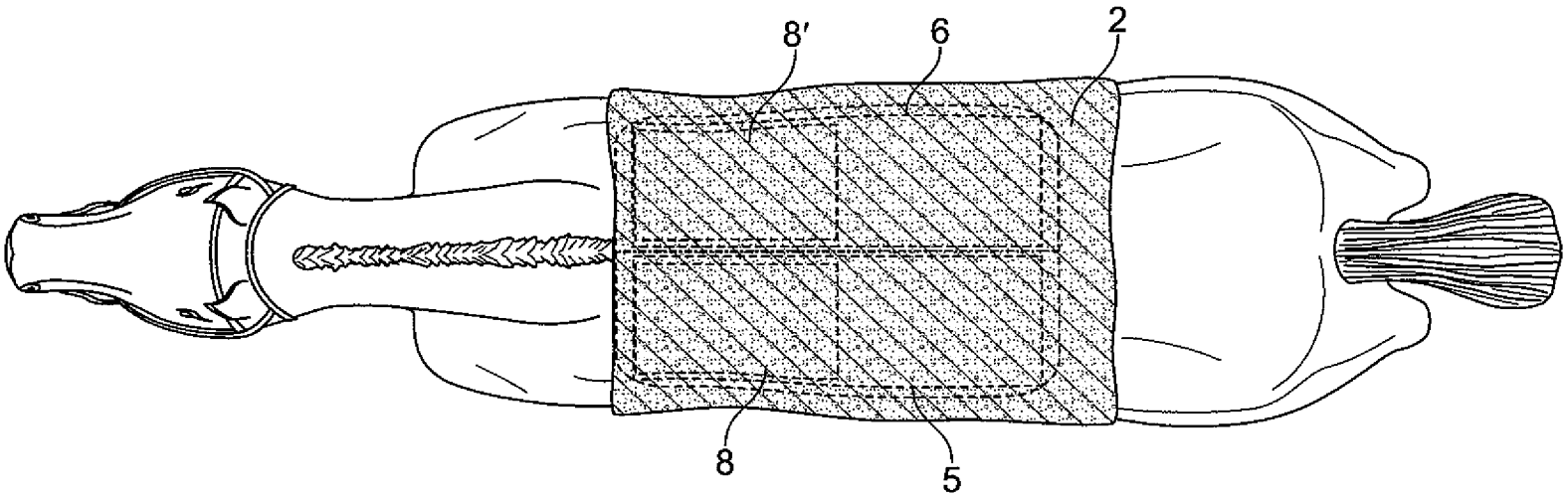
FIG. 11 shows from above the pad on a horse without saddle.

FIG. 11 shows the connection parts coupled together.

So by activating the pump, a pressure in the two cushions will be the same and secure a uniform behaviour of the saddle.

The invention claimed is:

1. A saddle pad for a western saddle, said saddle pad comprising:

a single flexible upper layer and two side-by-side lower layers that are stitched together and stitched to the upper layer so as to form therewith two respective cavities between the lower layers and the upper layer, two cushions assemblies respectively positioned in said two cavities, each of the cushion assemblies including a flexible carrier member, a cushion thereon defining opposed cushion layers, a partition wall between said cushion layers, and a valve for inflating the cushion with air, and a pump unit for connection to each of said air valves, said partition wall within each cushion controlling flow of air therein.

2. The saddle pad according to claim 1, wherein the pump unit is fixed to a male connection part having two male outlets, said outlets being connectible to a female connection part having two female inlets, said female connection part being fixed to the two valves.

3. The saddle pad according to claim 2, wherein the male connection part has two tongues adapted to grip the female connection part.

4. The saddle pad according to claim 1, including a plurality of partition walls at a rear wall of each cushion, each of the partition walls extending forwardly from the rear wall of the cushion.

5. The saddle pad according to claim 4, wherein said plurality of partition walls extend essentially in parallel with a central line of the pad, and at least one barrier wall which extends between the rear wall of the cushion and an outermost lateral wall.

6. The saddle pad according to claim 4, wherein each partition wall has a length which essentially corresponds to half a length of the cushion.

7. The saddle pad according to claim 4, wherein each partition wall is formed by stitching the opposed cushion layers together.

8. The saddle pad according to claim 1, wherein the cushions are made of air-tight sheets.

* * * * *